US008538283B2

(12) United States Patent
Negishi

(10) Patent No.: US 8,538,283 B2
(45) Date of Patent: Sep. 17, 2013

(54) IMAGE FORMING APPARATUS HAVING CONTROL UNIT

(75) Inventor: Koichi Negishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 929 days.

(21) Appl. No.: 12/580,806

(22) Filed: Oct. 16, 2009

(65) Prior Publication Data

US 2010/0098445 A1 Apr. 22, 2010

(30) Foreign Application Priority Data

Oct. 17, 2008 (JP) ..... 2008-268183

(51) Int. Cl.
*G03G 15/08* (2006.01)
*G03G 15/00* (2006.01)

(52) U.S. Cl.
USPC ..... 399/53; 399/384; 399/388

(58) Field of Classification Search
USPC ..... 399/66, 43, 67, 69, 53, 298, 299, 399/111, 384, 388, 397
See application file for complete search history.

(56) References Cited

U.S. PATENT DOCUMENTS

2003/0123893 A1* 7/2003 Fukano et al. ..... 399/69
2007/0264059 A1* 11/2007 Maeda et al.
2008/0226363 A1* 9/2008 Tateishi et al.

FOREIGN PATENT DOCUMENTS

JP 06250541 A * 9/1994
JP 2000-327189 A 11/2000
JP 2002108122 A * 4/2002
JP 2004291331 A * 10/2004
JP 2006227422 A * 8/2006

* cited by examiner

*Primary Examiner* — Walter L Lindsay, Jr.
*Assistant Examiner* — Milton Gonzalez
(74) *Attorney, Agent, or Firm* — Kubotera & Associate LLC

(57) ABSTRACT

An image forming apparatus for printing an image on a continuous print medium includes an image processing unit for converting print data received to image data printable; a developer image forming unit for forming a developer image using specific developer according to the image data; a transfer unit for transporting the continuous print medium and transferring the developer image to the continuous print medium; and a control unit for instructing timings of the developer image forming unit to form the developer image and the transfer unit to transport the continuous print medium when the control unit receives a conversion process completion notice from the image processing unit. Further, it is arranged so that an initialization operation of the developer image forming unit is performed before the developer image forming unit forms the developer image.

6 Claims, 5 Drawing Sheets

IMAGE FORMING APPARATUS HAVING CONTROL UNIT

BACKGROUND OF THE INVENTION AND RELATED ART STATEMENT

The present invention relates to an image forming apparatus. In particular, the present invention relates to an image forming apparatus for forming an image on a continuous print medium having a long sheet shape.

In a conventional image forming apparatus for forming an image on a continuous print medium, when a print job is complete, the continuous print medium is cut. After the continuous print medium is cut, a printing operation is resumed (refer to Patent Reference).

Patent Reference: Japan Patent Publication No. 2000-327189

As described above, in the conventional image forming apparatus, the continuous print medium is cut per every print job. Accordingly, it is necessary to reset the continuous print medium every time when the printing operation is resumed, thereby causing inconvenience. Further, when the continuous print medium is cut, a space is created in the continuous print medium. Accordingly, it is difficult to efficiently utilize the continuous print medium.

In view of the problems described above, an object of the present invention is to provide an image forming apparatus capable of solving the problems of the conventional image forming apparatus.

Further objects and advantages of the invention will be apparent from the following description of the invention.

SUMMARY OF THE INVENTION

In order to attain the objects described above, according to an aspect of the present invention, an image forming apparatus for printing an image on a continuous print medium includes an image processing unit for converting print data received to image data printable; a developer image forming unit for forming a developer image using specific developer according to the image data; a transfer unit for transporting the continuous print medium and transferring the developer image to the continuous print medium; and a control unit for instructing timings of the developer image forming unit to form the developer image and the transfer unit to transport the continuous print medium when the control unit receives a conversion process completion notice from the image processing unit. Further, it is arranged so that an initialization operation of the developer image forming unit is performed before the developer image forming unit forms the developer image.

In the present invention, it is possible to perform a print job without cutting the continuous print medium every time when the print job is completed. Accordingly, it is possible to efficiently use a space of the continuous print medium and reduce a printing time.

BRIEF DESCRIPTION OF THE DRAWINGS

FIG. 3(*b*) is a time chart showing an operation timing of an initialization operation of the image forming apparatus according to the first embodiment of the present invention;

DETAILED DESCRIPTION OF THE PREFERRED EMBODIMENTS

Hereunder, embodiments of the present invention will be described in detail with reference to the accompanying drawings.

First Embodiment

Figure 1:
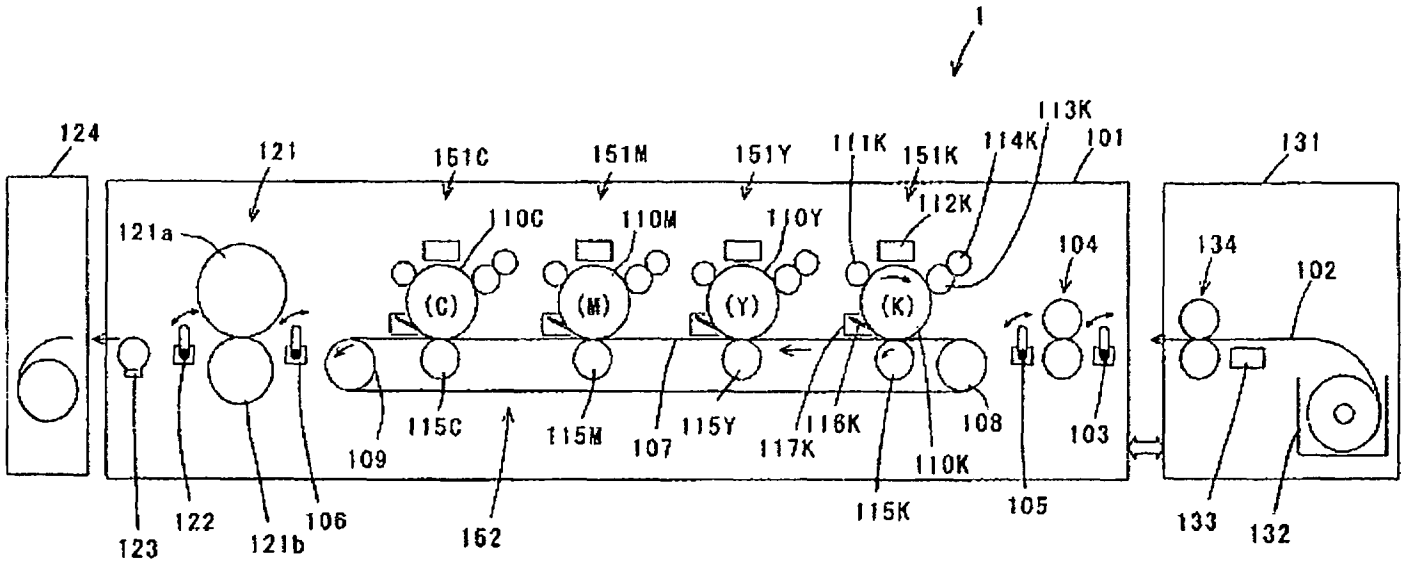
FIG. 1 is a schematic side view showing a main configuration of an image forming apparatus according to a first embodiment of the present invention.

A first embodiment of the present invention will be explained. FIG. 1 is a schematic side view showing a main configuration of a color printer as an image forming apparatus 1 according to the first embodiment of the present invention.

As shown in FIG. 1, the image forming apparatus 1 includes a medium sheet supply mechanism 131; a printing unit 101; and a winding device 124. The medium sheet supply mechanism 131 supplies a continuous print medium 102. After the printing unit 101 prints on the continuous print medium 102, the winding device 124 winds the continuous print medium 102.

In the embodiment, the medium sheet supply mechanism 131 includes a medium stacker 132 for retaining the continuous print medium 102 wound in a roll shape; a medium detection unit 133 for detecting the continuous print medium 102 passing therethrough; and a second medium transportation unit 134. The second medium transportation unit 134 pulls out the continuous print medium 102 from the medium stacker 132, and transports the continuous print medium 102 thus pulled out to the printing unit 101.

In the embodiment, the printing unit 101 has a configuration of a tandem type color electric photography printer capable of printing in four colors, i.e., black (K), yellow (Y), magenta (M), and cyan (C). Further, the printing unit 101 includes a sheet supply detection unit 103; a first medium transportation unit 104; a medium leading edge detection unit 105; an image forming unit (described later); a loosened medium detection unit 106; a fixing unit 121; a first discharge detection unit 122; and a second discharge detection unit 123 disposed in this order from an upstream side in a transportation direction that the continuous print medium 102 is transported.

In the embodiment, the image forming unit includes developing devices 151K, 151Y, 151M, and 151C (collectively referred to as a developing device 151) for black (K), yellow (Y), magenta (M), and cyan (C); and a transfer unit 152 having transfer belt drive units 108 and 109; a transfer belt 107; and transfer rollers 115K, 115Y, 115M, and 115C (collectively referred to as a transfer roller 115). The developing devices 151K, 151Y, 151M, and 151C as developer image forming units are arranged in this order from the upstream side in the transportation direction that the continuous print medium 102 is transported.

In the embodiment, the developing devices 151K, 151Y, 151M, and 151C arranged linearly have an identical configuration, and use toner as developer in difference colors, i.e., black (K), yellow (Y), magenta (M), and cyan (C). In the following description, the configuration of the developing device 151K of black (K) will be explained as an example, and explanations of the configuration of the developing devices 151Y, 151M, and 151C are omitted.

In the embodiment, the developing device 151K of black (K) includes a photosensitive drum 110K rotating in an arrow direction for supporting a toner developer image; a charge roller 111K for charging a surface of the photosensitive drum 110K; an exposure device 112K formed of an LED (Light Emitting Diode) head for forming a static latent image on the surface of the photosensitive drum 110K; a developing roller 113K for developing the static latent image using toner to form the toner developer image; a toner supply roller 114K for supplying toner from a toner tank (not shown) to the developing roller 113K; a cleaning blade 116K for removing toner remaining on the photosensitive drum 110K after the toner developer image on the photosensitive drum 110K is transferred to the continuous print medium 102; and a waste toner collection unit 117K for collecting toner remaining on the photosensitive drum 110K (waste toner) thus removed.

Similarly, the developing devices 151Y, 151M, and 151C include photosensitive drums 110Y, 110M, and 110C (collectively referred to as a photosensitive drum 110 including the photosensitive drum 110K); charge rollers 111Y, 111M, and 111C (collectively referred to as a charge roller 111 including the charge roller 111K); exposure devices 1121, 112M, and 112C (collectively referred to as an exposure device 112 including the exposure device 112K); developing rollers 113Y, 113M, and 113C (collectively referred to as a developing roller 113 including the developing roller 113K); toner supply rollers 114Y, 114M, and 114C (collectively referred to as a toner supply roller 114 including the toner supply roller 114K); cleaning blades 116Y, 116M, and 116C (collectively referred to as a cleaning blade 116 including the cleaning blade 116K); and waste toner collection units 117Y, 117M, and 117C (collectively referred to as a waste toner collection unit 117 including the waste toner collection unit 117K), respectively.

In the embodiment, the transfer roller 115K of the transfer unit 152 is pressed against the photosensitive drum 110K through the transfer belt 107 to rotate in an arrow direction. The transfer belt drive units 108 and 109 drive the transfer belt 107 to rotate in an arrow direction for transporting the continuous print medium 102, so that the transfer roller 115K transfers the toner image on the photosensitive drum 110K to the continuous print medium 102.

Accordingly, when the transfer belt 107 transports the continuous print medium 102 to pass through the developing device 151K, the toner image in black is transferred to the continuous print medium 102. Similarly, when the transfer belt 107 transports the continuous print medium 102 to pass through the developing devices 151Y, 151M, and 151C, the toner image in yellow, the toner image in magenta, and the toner image in cyan are sequentially overlapped and transferred to the continuous print medium 102.

In the embodiment, the fixing unit 121 includes a heating roller 121*a* and a pressing roller 121*b*. After the developing device 151 and the transfer roller 115 sequentially overlap and transfer the toner images in colors to the continuous print medium 102, the heating roller 121*a* and the pressing roller 121*b* presses and heats the toner images, so that the toner images are fixed to the continuous print medium 102. After the toner images are fixed to the continuous print medium 102, the winding device 124 disposed at a last stage winds the continuous print medium 102.

Figure 2:
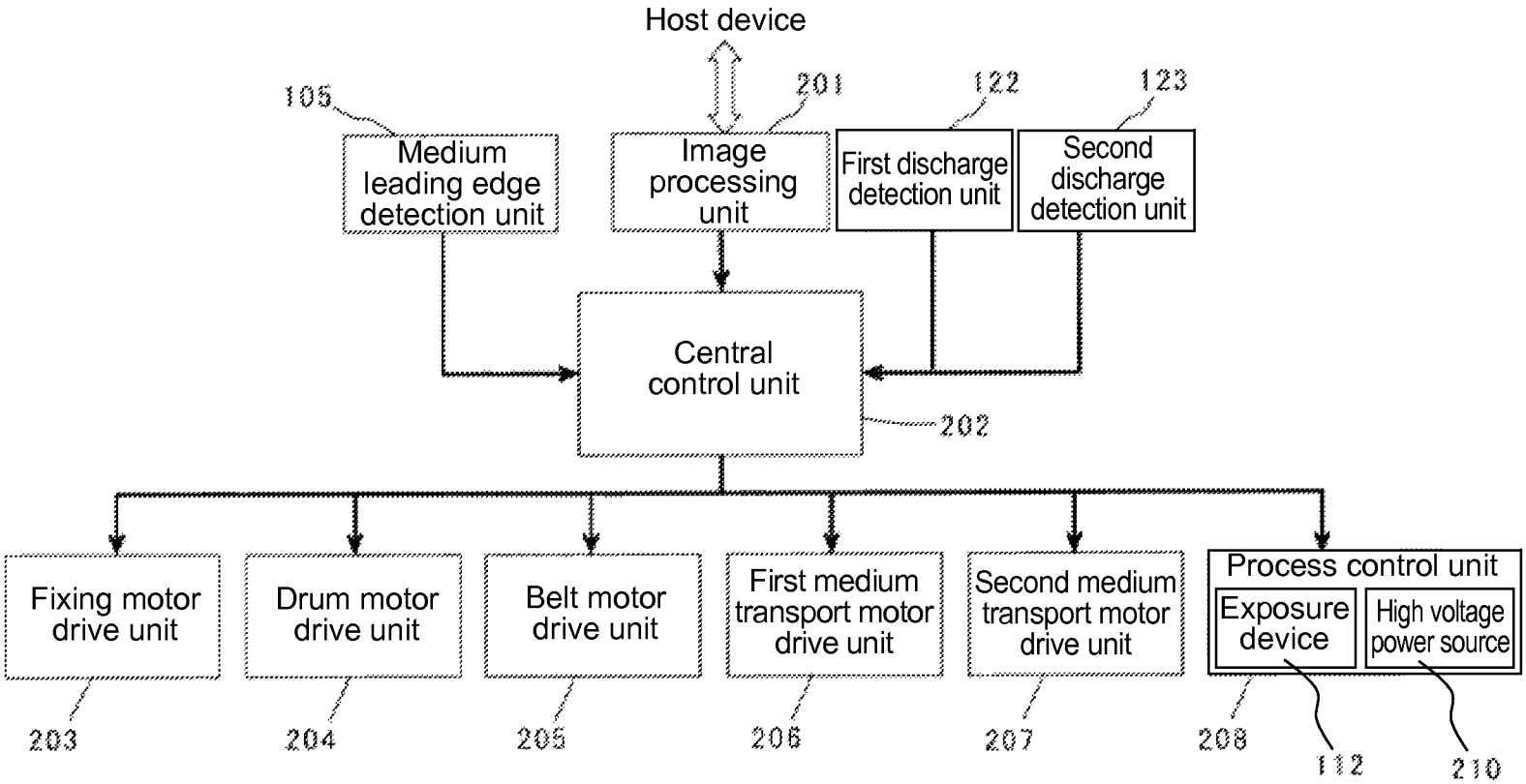
FIG. 2 is a block diagram showing a control system of the image forming apparatus according to the first embodiment of the present invention.

FIG. 2 is a block diagram showing a control system of the image forming apparatus 1 according to the first embodiment of the present invention. The control system of the image forming apparatus 1 will be explained next with reference to FIGS. 1 and 2.

As shown in FIG. 2, the control system includes an image processing unit 201 for receiving print data from a host device such as a personal computer connected to the image forming apparatus 1, and for converting the print data thus received to image data printable. The control system further includes a central control unit 202 connected to the medium leading edge detection unit 105, the first discharge detection unit 122, and the second discharge detection unit 123. The medium leading edge detection unit 105, the first discharge detection unit 122, and the second discharge detection unit 123 are arranged in the image forming apparatus 1 as shown in FIG. 1.

In the embodiment, the control system further includes a fixing motor drive unit 203 for driving a fixing motor (not shown) to rotate the heating roller 121*a* and the pressing roller 121*b* of the fixing unit 121 (refer to FIG. 1). The control system further includes a drum motor drive unit 204 for driving a drum motor (not shown) to rotate the photosensitive drum 110 (refer to FIG. 1). The control system further includes a belt motor drive unit 205 for driving a belt motor (not shown) to drive the transfer belt drive units 108 and 109 (refer to FIG. 1), thereby rotating the transfer belt 107.

In the embodiment, the control system further includes a first medium transport motor drive unit 206 for driving a first sheet supply motor (not shown) to drive the first medium transportation unit 104 (refer to FIG. 1). The control system further includes a second medium transport motor drive unit 207 for driving a second sheet supply motor (not shown) to drive the second medium transportation unit 134 (refer to FIG. 1). The control system further includes a process control unit 208 formed of a high voltage power source 210 and the exposure device 112 (refer to FIG. 1).

In the embodiment, the high voltage power source 210 is connected to the charge roller 111, the developing roller 113, the toner supply roller 114, and the transfer roller 115 of the image forming unit for supplying a high voltage necessary for each component. The central control unit 202 is connected to the fixing motor drive unit 203, the drum motor drive unit 204, the belt motor drive unit 205, the first medium transport motor drive unit 206, the second medium transport motor drive unit 207, and the high voltage power source 210 for instructing an operation of each component and controlling an entire operation of the image forming apparatus 1.

Figures 3A, 3B:
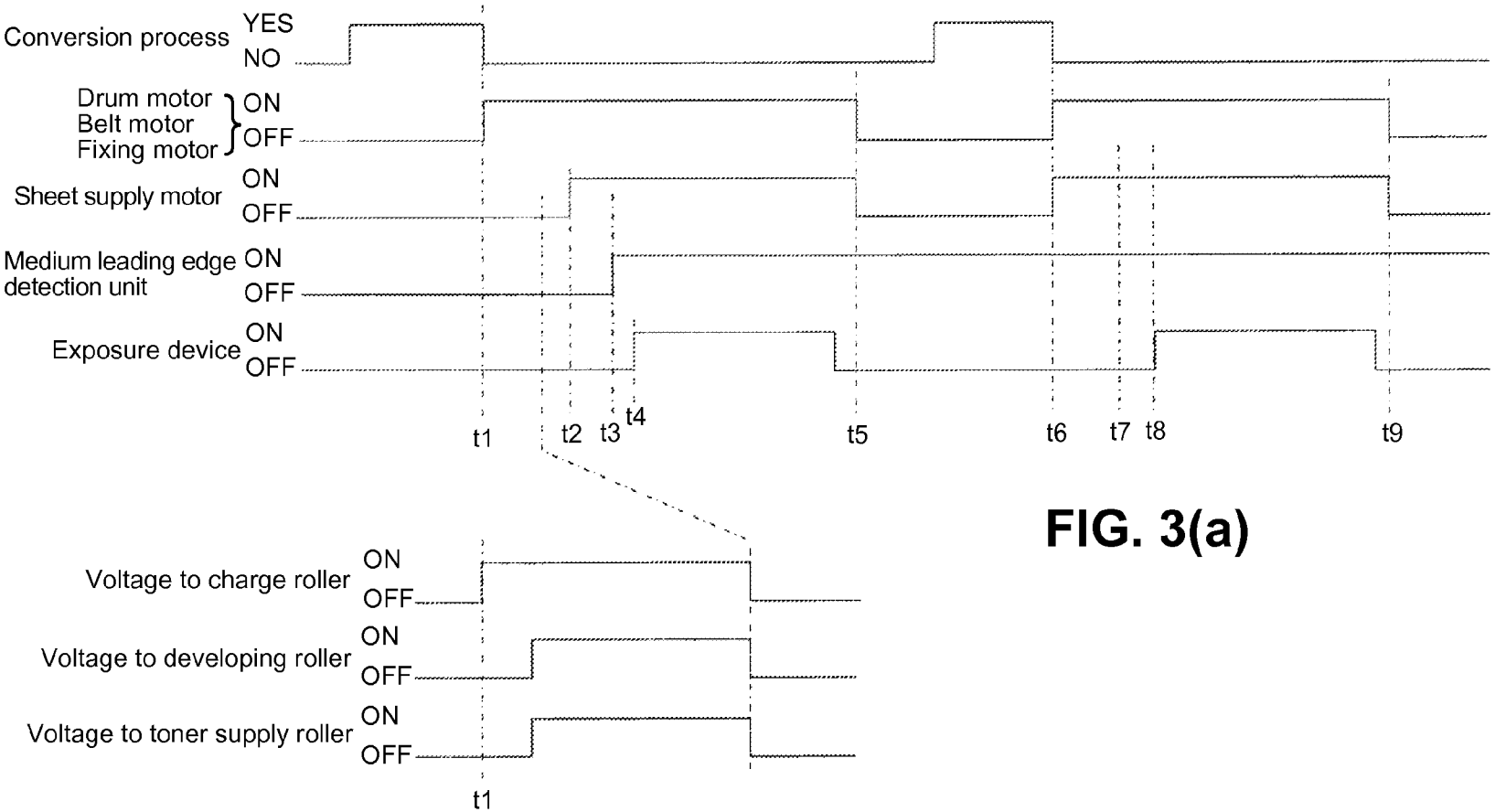
FIG. 3(*a*) is a time chart showing an operation control timing of the image forming apparatus according to the first embodiment of the present invention.

An operation of the image forming apparatus 1 will be explained next with reference to time charts shown in FIGS. 3(*a*) and 3(*b*). FIG. 3(*a*) is a time chart showing an operation control timing of the image forming apparatus 1 according to the first embodiment of the present invention.

When the image processing unit 201 receives the print data as a first print job from the host device, the image processing unit 201 deploys the print data to image information and converts the print data to the image data. After the image processing unit 201 converts the print data to the image data, the image processing unit 201 notifies the central control unit 202 that the conversion process is complete.

As shown in FIG. 3(*a*), when the central control unit 202 receives the notice from the image processing unit 201 at a timing t1, the central control unit 202 sends signals to the drum motor drive unit 204, the belt motor drive unit 205, and the fixing motor drive unit 203 to drive the drum motor of the photosensitive drum 110, the belt motor of the transfer belt 107, and the fixing motor of the fixing unit 121, respectively. At the same time, the central control unit 202 sends a signal to the process control unit 208 to instruct the high voltage power source 210, so that an initialization operation of a process starts at the same time when the photosensitive drum 110 starts rotating.

FIG. 3(*b*) is a time chart showing an operation timing of the initialization operation of the image forming apparatus 1 according to the first embodiment of the present invention.

As shown in FIG. 3(*b*), the high voltage power source 210 applies a voltage to the high voltage power source 210 at the same time when the photosensitive drum 110 starts rotating. When a position of the photosensitive drum 110 contacting with the charge roller 111 moves to a position contacting with the developing roller 113 upon rotating, the high voltage power source 210 applies a high voltage to the developing roller 113 and the toner supply roller 114. Afterward, the high voltage thus applied is maintained for a period of time that the photosensitive drum 110 rotates at least one rotation since the photosensitive drum 110 starts rotating, thereby completing the initialization operation of the image forming apparatus 1.

When the image forming apparatus 1 as the electro-photography printer starts a printing operation, it is necessary to establish a static state of a component dealing with static electricity such as the charge roller 111, the developing roller 113, the toner supply roller 114, and the photosensitive drum 110 within a specific allowable range in a balanced state. With the initialization operation of the image forming apparatus 1 described above, it is possible to establish the balanced state.

After the initialization operation of the image forming apparatus 1, the central control unit 202 sends a signal to the first medium transport motor drive unit 206 and the second medium transport motor drive unit 207 at a timing t2. Accordingly, the first sheet supply motor and the second sheet supply motor are driven, so that the first medium transportation unit 104 and the second medium transportation unit 134 start supplying the continuous print medium 102. Note that the high voltage power source 210 applies a high voltage different from that in the initialization operation to the charge roller 111, the developing roller 113, and the toner supply roller 114 at the timing t2 when the first sheet supply motor and the second sheet supply motor are driven (not shown).

When the continuous print medium 102 passes through the medium leading edge detection unit 105 at a timing t3, a sensor signal of the medium leading edge detection unit 105 changes. Accordingly, the central control unit 202 confirms that a leading edge of the continuous print medium 102 reaches the medium leading edge detection unit 105. Afterward, the central control unit 202 sends the image data converted as printable data to the exposure device 112 at a timing t4 after a specific period of time from when the leading edge of the continuous print medium 102 is detected. Accordingly, the exposure device 112 starts an exposure process to form the static latent image on the photosensitive drum 110.

Afterward, the developing roller 113 develops the static latent image to form the toner image on the photosensitive drum 110, and the transfer roller 115 transfers the toner image to the continuous print medium 102. Then, the fixing unit 121 fixes the toner image to the continuous print medium 102, thereby completing the printing operation.

In the description above, the transfer process of the developing device 151 and the transfer roller 115 with respect to the continuous print medium 102 is explained collectively. In an actual case, the developing devices 151K, 151Y, 151M, and 151C and the transfer rollers 115K, 115Y, 115M, and 115C operate at operation timings shifted by a time difference in timings when the continuous print medium 102 passes through different transfer positions corresponding to each color.

When the printing operation is complete at a timing t5, the central control unit 202 sends signals to the drum motor drive unit 204, the belt motor drive unit 205, the fixing motor drive unit 203, the first medium transport motor drive unit 206, and the second medium transport motor drive unit 207 to stop the belt motor, the fixing motor, the first sheet supply motor, and the second sheet supply motor, respectively. Further, the high voltage power source 210 stops applying the voltages to the charge roller 111, the developing roller 113, and the toner supply roller 114. At this moment, the continuous print medium 102 stays in a stationary state on a transportation path.

In order to prevent the fixing unit 121 from excessively heating the continuous print medium 102, it may be arranged to move at least one of the heating roller 121*a* and the pressing roller 121*b* of the fixing unit 121, so that the heating roller 121*a* is situated away from the pressing roller 121*b*. Further, when it is specified that the printing operation is performed on the continuous print medium 102, a fixing temperature may be set to a lower level, so that it is controlled such that the continuous print medium 102 is transported at a slower transportation speed.

In the next step, when the image processing unit 201 receives the print data as a second print job from the host device, similar to the first print job, the image processing unit 201 deploys the print data to image information and converts the print data to the image data. After the image processing unit 201 converts the print data to the image data, the image processing unit 201 notifies the central control unit 202 that the conversion process is complete.

At this moment, a signal of the medium leading edge detection unit 105 or the first discharge detection unit 122 is turned on. Accordingly, when the central control unit 202 receives the notice from the image processing unit 201 at a timing t6, the central control unit 202 confirms that the central control unit 202 stays in the stationary state on the transportation path, and starts controlling the process.

More specifically, the central control unit 202 sends signals to the drum motor drive unit 204, the belt motor drive unit 205, the fixing motor drive unit 203, the first medium transport motor drive unit 206, and the second medium transport motor drive unit 207 to drive the drum motor, the belt motor, the fixing motor, the first sheet supply motor, and the second sheet supply motor, respectively. At the same time, the central control unit 202 sends a signal to the process control unit 208 to instruct the high voltage power source 210, so that the initialization operation of the process starts at the same time when the photosensitive drum 110 starts rotating. The initialization operation is the same as that starting at the timing t1 shown in FIG. 3(*b*), and an explanation thereof is omitted.

In the initialization operation, it may be arranged to move at least one of the photosensitive drum 110 of the developing device 151 and the transfer belt 107, so that the photosensitive drum 110 of the developing device 151 is situated and rotates away from the transfer belt 107. In this case, it is not necessary to rotate the transfer belt 107.

After the initialization operation, when the transfer belt 107 contacts with the photosensitive drum 110, the heating roller 121*a* and the pressing roller 121*b* of the fixing unit 121 rotate to pull the continuous print medium 102, thereby removing a slack of the continuous print medium 102. Afterward, the transfer belt 107, the first medium transportation unit 104, and the second medium transportation unit 134 are driven.

When the initialization operation is complete, different from when the print data are printed for the first time, the continuous print medium 102 is situated on the transportation path already. Accordingly, the high voltage power source 210 applies a high voltage different from that in the initialization operation to the charge roller 111, the developing roller 113, and the toner supply roller 114 at a timing t7 when the initialization operation is complete (not shown). Afterward, the central control unit 202 sends the image data converted as printable data to the exposure device 112 at a timing t8 after a specific period of time. Accordingly, the exposure device 112 starts the exposure process to form the static latent image on the photosensitive drum 110.

Afterward, similar to the printing operation of the print data for the first time after the timing t4, the developing roller 113 develops the static latent image to form the toner image on the photosensitive drum 110, and the transfer roller 115 transfers the toner image to the continuous print medium 102. Then, the fixing unit 121 fixes the toner image to the continuous print medium 102, thereby completing the printing operation.

When the printing operation is complete at a timing t9, the central control unit 202 sends signals to the drum motor drive unit 204, the belt motor drive unit 205, the fixing motor drive unit 203, the first medium transport motor drive unit 206, and the second medium transport motor drive unit 207 to stop the belt motor, the fixing motor, the first sheet supply motor, and the second sheet supply motor, respectively. Further, the high voltage power source 210 stops applying the voltages to the charge roller 111, the developing roller 113, and the toner supply roller 114.

As described above, in the embodiment, the image forming apparatus 1 resumes the printing operation without cutting the continuous print medium 102. Accordingly, it is not necessary to set the continuous print medium 102 one more time every time when the print job is received and the printing operation is resumed.

Second Embodiment

Figure 4:
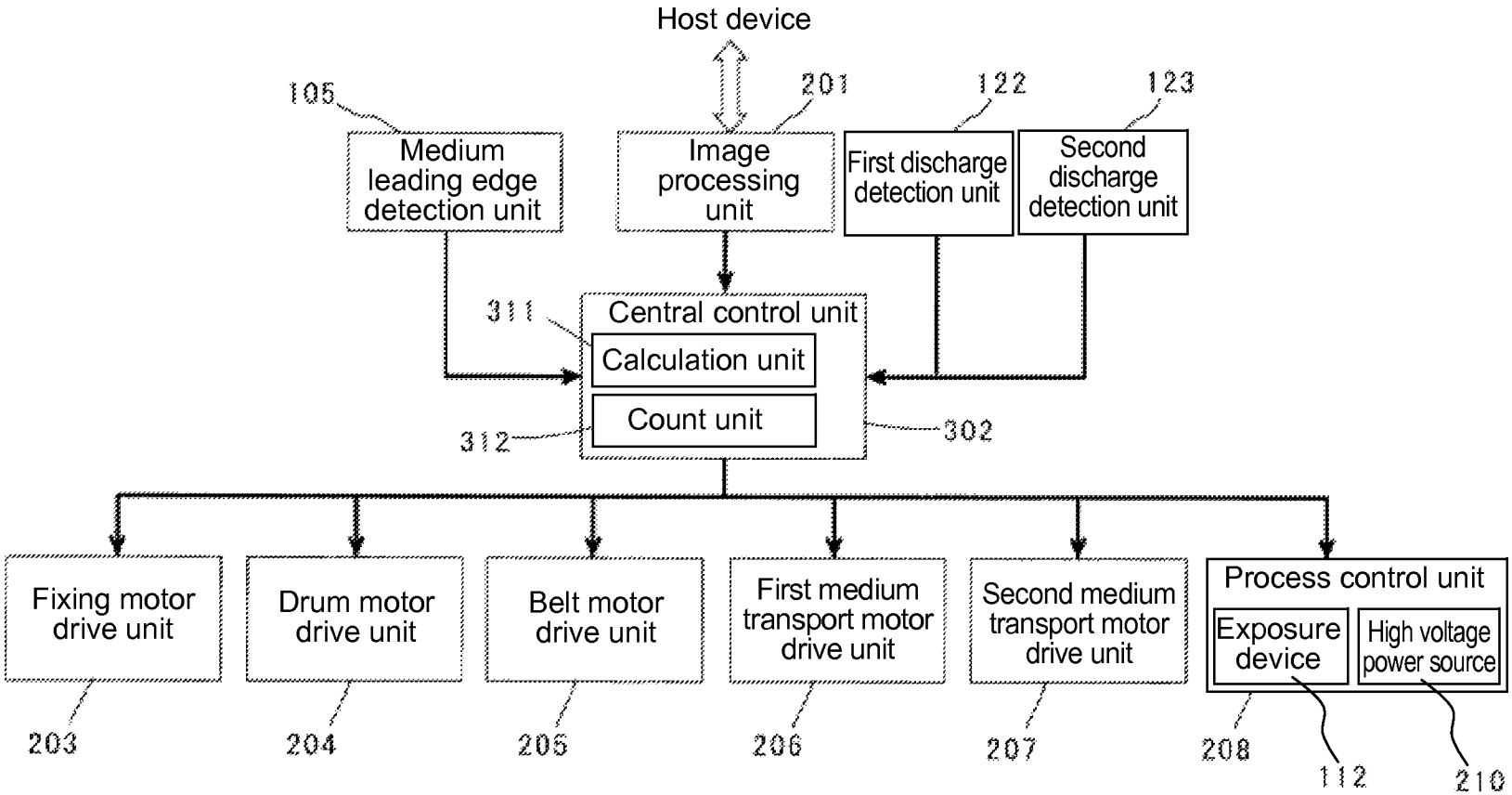
FIG. 4 is a block diagram showing a control system of an image forming apparatus according to a second embodiment of the present invention.

A second embodiment of the present invention will be explained next. FIG. 4 is a block diagram showing a control system of an image forming apparatus according to the second embodiment of the present invention.

In the image forming apparatus in the second embodiment shown in FIG. 4, different from the image forming apparatus 1 in the first embodiment shown in FIG. 2, a central control unit 302 includes a calculation unit 311 and a count unit 312. According to the different configuration, the central control unit 302 operates in a different operation.

Components of the image forming apparatus in the second embodiment similar to those of the image forming apparatus 1 in the first embodiment are designated with the same reference numerals, and explanations thereof are omitted. Note that the image forming apparatus in the second embodiment includes the components similar to those of the image forming apparatus 1 in the first embodiment shown in FIG. 1, and the following description refers to FIG. 1 as necessary.

As shown in FIG. 4, the central control unit 302 includes the count unit 312 for counting a period of time (described later) from when the first print job is complete to when the image processing unit 201 performs the conversion process on the next print job. The central control unit 302 further includes the calculation unit 311 for determining whether a measured value of the count unit 312 is within a specific period of time (described later).

Figure 5:
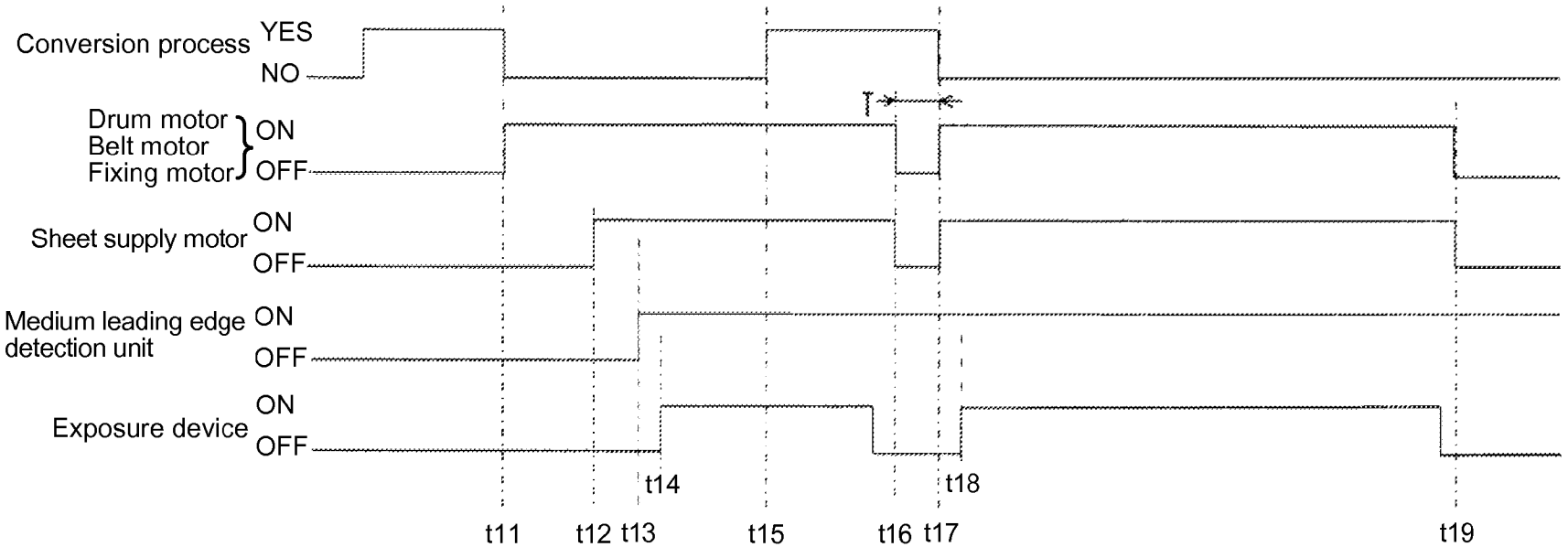
FIG. 5 is a time chart showing an operation control timing of the image forming apparatus according to the second embodiment of the present invention.

An operation of the image forming apparatus will be explained next with reference to a time chart shown in FIG. 5. FIG. 5 is the time chart showing an operation control timing of the image forming apparatus according to the second embodiment of the present invention.

When the image processing unit 201 receives the print data as the first print job from the host device, the image processing unit 201 deploys the print data to the image information and converts the print data to the image data. After the image processing unit 201 converts the print data to the image data, the image processing unit 201 notifies the central control unit 202 that the conversion process is complete.

As shown in FIG. 5, when the central control unit 302 receives the notice from the image processing unit 201 at a timing t11, the central control unit 302 sends signals to the drum motor drive unit 204, the belt motor drive unit 205, and the fixing motor drive unit 203 to drive the drum motor, the belt motor, and the fixing motor, respectively. At the same time, the central control unit 302 sends a signal to the process control unit 208 to instruct the high voltage power source 210, so that the initialization operation of the process starts at the same time when the photosensitive drum 110 starts rotating. The initialization operation is the same as that starting at the timing t1 shown in FIG. 3(*b*), and an explanation thereof is omitted.

After the initialization operation, the central control unit 302 sends a signal to the first medium transport motor drive unit 206 and the second medium transport motor drive unit 207 at a timing t12. Accordingly, the first sheet supply motor and the second sheet supply motor are driven, so that the first medium transportation unit 104 and the second medium transportation unit 134 start supplying the continuous print medium 102. Note that the high voltage power source 210 applies a high voltage different from that in the initialization operation to the charge roller 111, the developing roller 113, and the toner supply roller 114 at the timing t12 when the first sheet supply motor and the second sheet supply motor are driven (not shown).

When the continuous print medium 102 passes through the medium leading edge detection unit 105 at a timing t13, a sensor signal of the medium leading edge detection unit 105 changes. Accordingly, the central control unit 302 confirms that the leading edge of the continuous print medium 102 reaches the medium leading edge detection unit 105. The operation up to this step is the same as that of the image forming apparatus 1 in the first embodiment.

Afterward, the central control unit 302 sends the image data converted as printable data to the exposure device 112 at a timing t14 after a specific period of time from when the leading edge of the continuous print medium 102 is detected. Accordingly, the exposure device 112 starts the exposure process to form the static latent image on the photosensitive drum 110.

While the static latent image is formed during the exposure process, when the image processing unit 201 receives the print data as the second print job from the host device at a timing t15, the image processing unit 201 deploys the print data to the image information and converts the print data to the image data. After the developing roller 113 develops the static latent image formed on the photosensitive drum 110 to form the toner image in the first print job, and the transfer roller 115 transfers the toner image to the continuous print medium 102, the fixing unit 121 fixes the toner image to the continuous print medium 102, thereby completing the printing operation.

When the printing operation is complete at a timing t16, the central control unit 302 sends signals to the drum motor drive unit 204, the belt motor drive unit 205, the fixing motor drive unit 203, the first medium transport motor drive unit 206, and the second medium transport motor drive unit 207 to stop the belt motor, the fixing motor, the first sheet supply motor, and the second sheet supply motor, respectively. Further, the high voltage power source 210 stops applying the voltages to the charge roller 111, the developing roller 113, and the toner supply roller 114. At this moment, the continuous print medium 102 stays in the stationary state on the transportation path.

At this moment, the image processing unit 201 has not completed the transfer process. Accordingly, the central control unit 302 controls the count unit 312 to start counting at the timing t16 when the printing operation of the first print job is complete, thereby measuring a wait time T until a timing t17 when the image processing unit 201 completes the conversion process of the second print job. More specifically, when the image processing unit 201 notifies the central control unit 302 that the conversion process is complete, the count unit 312 stops counting. Then, the calculation unit 311 determines whether a measured value of the count unit 312 at this moment is within the specific period of time.

In the embodiment, the specific period of time is determined according to a dark decay time of the photosensitive drum 110 of the printing unit 101, and does not affect on the printing operation. More specifically, the specific period of time may be set to two seconds within which the photosensitive drum 110 does not decay to an extent that the initialization operation is necessary. A dark decay is a phenomenon in which a surface potential of the photosensitive drum 110 decays even in a dark place due to charged carriers or thermally excited carriers after the charge roller 111 charges the surface of the photosensitive drum 110.

In the next step, when the image processing unit 201 notifies the central control unit 302 that the conversion process is complete or the printing operation is ready to start at a timing t17, the central control unit 302 determines whether the wait time T is within the specific period of time (two seconds in the embodiment). When the central control unit 302 determines that the wait time T is within the specific period of time, the central control unit 302 determines that the initialization operation is not necessary.

Accordingly, without performing the initialization operation shown in FIG. 3(*b*), the central control unit 302 sends the signals to the drum motor drive unit 204, the belt motor drive unit 205, the fixing motor drive unit 203, the first medium transport motor drive unit 206, and the second medium transport motor drive unit 207 to drive the drum motor, the belt motor, the fixing motor, the first sheet supply motor, and the second sheet supply motor, respectively. Afterward, the central control unit 302 sends the image data converted as printable data to the exposure device 112 at a timing t18 after a specific period of time. Accordingly, the exposure device 112 starts the exposure process to form the static latent image on the photosensitive drum 110.

Note that the high voltage power source 210 applies a high voltage different from that in the initialization operation to the charge roller 111, the developing roller 113, and the toner supply roller 114 at the timing t17 when the first sheet supply motor and the second sheet supply motor are driven (not shown).

Afterward, the developing roller 113 develops the static latent image to form the toner image on the photosensitive drum 110, and the transfer roller 115 transfers the toner image to the continuous print medium 102. Then, the fixing unit 121 fixes the toner image to the continuous print medium 102, thereby completing the printing operation.

When the printing operation is complete at a timing t19, the central control unit 302 sends signals to the drum motor drive unit 204, the belt motor drive unit 205, the fixing motor drive unit 203, the first medium transport motor drive unit 206, and the second medium transport motor drive unit 207 to stop the belt motor, the fixing motor, the first sheet supply motor, and the second sheet supply motor, respectively. Further, the high voltage power source 210 stops applying the voltages to the charge roller 111, the developing roller 113, and the toner supply roller 114.

When the central control unit 302 determines that the wait time T is not within the specific period of time, the central control unit 302 determines that the initialization operation is necessary. Accordingly, similar to the process after the timing t6 shown in FIG. 3(*a*), the initialization operation of the process starts at the same time when the photosensitive drum 110 starts rotating. Afterward, the central control unit 302 sends the image data to the exposure device 112, so that the exposure device 112 starts the exposure process to form the static latent image on the photosensitive drum 110. The process after this step is similar to that described above.

As described above, in the embodiment, the central control unit 302 includes the calculation unit 311 and the count unit 312. Accordingly, even when the second print data are processed after a relatively long period of time after the first print data are processed, it is possible to continue the printing operation without performing the initialization operation when it is within the specific period of time. Accordingly, it is possible to efficiently print on the continuous print medium.

In the embodiments described above, the tandem type color electric photography printer capable of printing in four colors, i.e., black (K), yellow (Y), magenta (M), and cyan (C) is explained as the image forming apparatus. The present invention is not limited thereto, and is applicable to a monochrome printer as far as the image forming apparatus is an electro-photography apparatus for printing on a continuous medium.

The disclosure of Japanese Patent Application No. 2008-268183, filed on Oct. 17, 2008, is incorporated in the application by reference.

While the invention has been explained with reference to the specific embodiments of the invention, the explanation is illustrative and the invention is limited only by the appended claims.

What is claimed is:

1. An image forming apparatus for printing an image on a continuous print medium, comprising:

an image processing unit for converting print data to image data;

a developer image forming unit for forming a developer image according to the image data;

a transfer unit for transporting the continuous print medium and transferring the developer image to the continuous print medium; and a control unit for controlling the developer image forming unit to form the developer image and the transfer unit to transport the continuous print medium when the control unit receives a conversion process completion notice from the image processing unit, said control unit being arranged to perform an initialization operation before the developer image forming unit forms the developer image, wherein said control unit includes a count unit and a calculation unit, said count unit being arranged to count a period of time from when a first print job is completely printed to when the image processing unit completes a conversion process on a next print job, said calculation unit being arranged to determine whether the period of time is within a specific period of time so that the initialization operation is not performed when the period of time is less than the specific period of time.

2. The image forming apparatus according to claim 1, wherein said developer image forming unit includes a plurality of image forming units for forming developer images in different colors.

3. The image forming apparatus according to claim 1, wherein said developer image forming unit includes a photosensitive member; a charging unit for charging the photosensitive member; a developing unit for developing a static latent image formed on the photosensitive member; and a developer supplying member for supplying developer to the developing unit, said control unit being arranged to apply a voltage to the charging unit, the developing unit, and the developer supplying member and to rotate the photosensitive drum for a specific period of time during the initialization operation.

4. The image forming apparatus according to claim 3, wherein said control unit is arranged to rotate the photosensitive drum more than one rotation in the initialization operation.

5. The image forming apparatus according to claim 1, further comprising a fixing unit having a heating member and a pressing member.

6. The image forming apparatus according to claim 5, wherein said control unit drives the transfer unit after the fixing unit is operated.

* * * * *